US006230798B1

(12) United States Patent
Appleton

(10) Patent No.: US 6,230,798 B1
(45) Date of Patent: May 15, 2001

(54) INFLATABLE PACKER

(75) Inventor: Robert Patrick Appleton, Aberdeen (GB)

(73) Assignee: Smith INternational, Inc., Houston, TX (US)

( * ) Notice: Subject to any disclaimer, the term of this patent is extended or adjusted under 35 U.S.C. 154(b) by 0 days.

(21) Appl. No.: 09/125,084

(22) PCT Filed: Feb. 3, 1997

(86) PCT No.: PCT/GB97/00300

§ 371 Date: Nov. 18, 1998

§ 102(e) Date: Nov. 18, 1998

(87) PCT Pub. No.: WO97/28348

PCT Pub. Date: Aug. 7, 1997

(30) Foreign Application Priority Data

Feb. 3, 1996 (GB) ..... 9602219

(51) Int. Cl.[7] ..... E21B 23/06; E21B 33/127
(52) U.S. Cl. ..... 166/187; 166/122
(58) Field of Search ..... 166/187, 188, 166/192, 196, 386, 193, 387, 123, 122

(56) References Cited

U.S. PATENT DOCUMENTS 2,827,965 * 3/1958 Mounce ..... 166/187
3,270,814 * 9/1966 Richardson et al. ..... 166/291
3,529,665 * 9/1970 Malone ..... 166/187 X
4,082,298 * 4/1978 Sanford ..... 166/34.3
4,823,882 * 4/1989 Stokley et al. ..... 166/188 X
4,871,179 * 10/1989 Bell et al. ..... 166/187 X
5,375,662 * 12/1994 Echols, III et al. ..... 166/386
5,542,473 * 8/1996 Pringle et al. ..... 166/134 X

* cited by examiner

*Primary Examiner*—David Bagnell
*Assistant Examiner*—Kamal Dawelheit
(74) *Attorney, Agent, or Firm*—Dykema Gossett PLLC

(57) ABSTRACT

A hydraulic anchor packer for use in a well bore having an inflatable packer element (36) with a cylinder 38 and an elastomer sleeve 44 is provided on the exterior surface thereof. The elastomer sleeve 44 is retained by a suitable adhesive or fixing agent adjacent the cylinder 38 at the end portions of the elastomer sleeve 44 but is free of the cylinder 38 intermediate the end portions. An aperture 48 is defined by the wall of the cylinder 38 and is for connecting the exterior of the cylinder 38 in a region where the elastomer sleeve 44 is free of the interior of the cylinder 38. The anchor packer also has a seat 60 and a drop ball 62 for causing fluid from within the cylinder 38 to flow through the aperture 48 and between the elastomer sleeve 44 and exterior surface of the cylinder 38. The seat 60 and drop ball 62 are also for trapping fluid which has flowed into the chamber between the elastomer sleeve 44 and the cylinder 38 so as to prevent relaxation of the elastomer sleeve 44. The hydraulic anchor packer can be used in both cased and uncased well bores.

18 Claims, 2 Drawing Sheets

INFLATABLE PACKER

Figure 1:
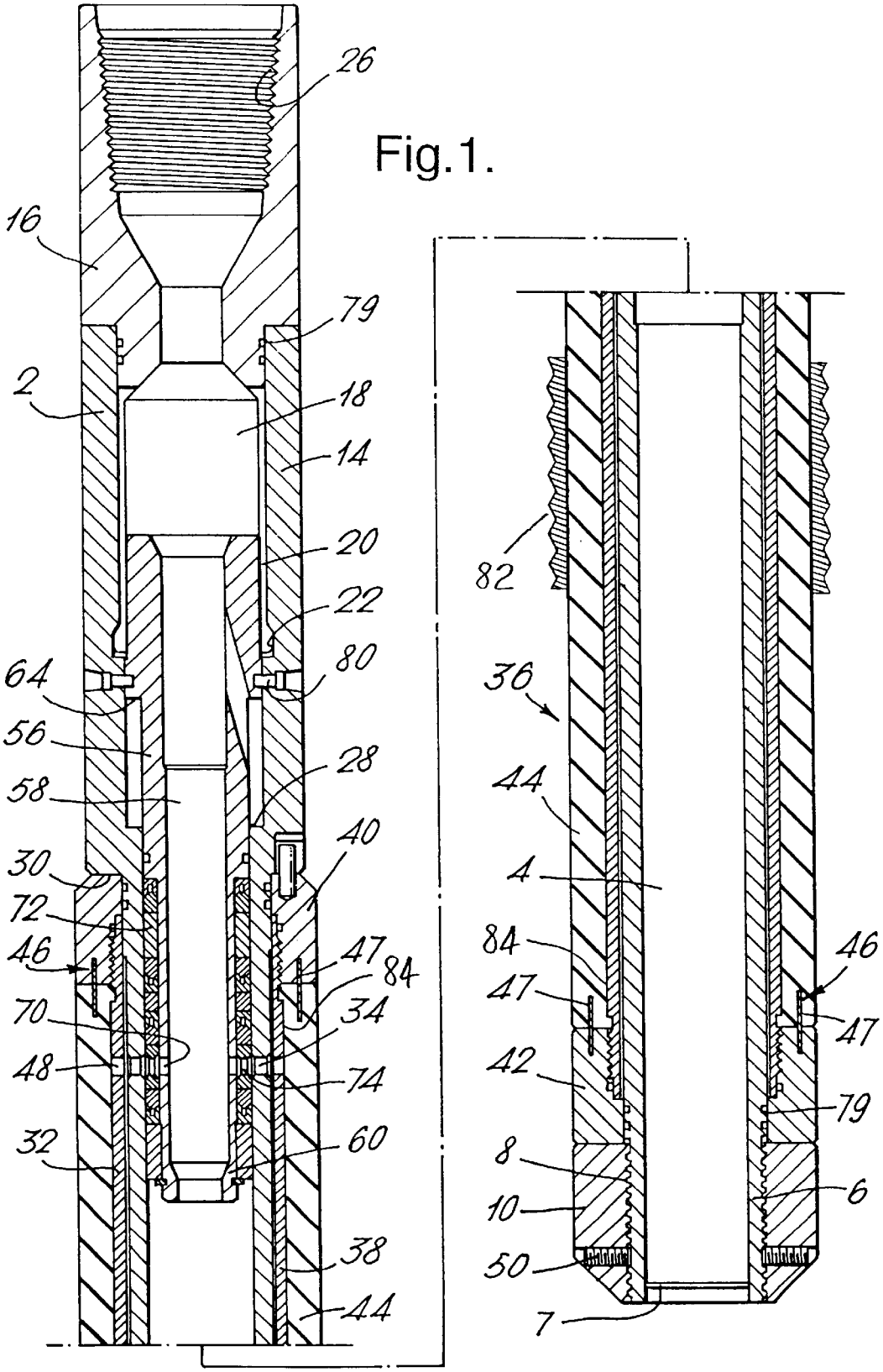

The invention relates to hydraulic anchor packers for use in well bores.

It is well known in the gas and oil drilling industry that hydraulic anchor packers may be used to isolate sections of a well bore and support materials and equipment within a well bore. Conventional hydraulic anchor packers typically comprise a plurality of metallic gripping elements having a serrated surface for engaging the wall of a well bore. The gripping elements are generally mounted on, or operated by, hydraulic pistons which move the gripping elements between a gripping and non-gripping position in response to a hydraulic pressure differential. Although such anchor packers operate very effectively, they are expensive to manufacture and use, and are unsuitable for use in uncased well bores.

It is an object of the present invention to provide an anchor packer which is relatively inexpensive to manufacture and use, and which is suitable for use in both cased and uncased well bores, and which is automatically released from the well bore string used to position it when it is set.

The invention provides a hydraulic anchor packer for use in a well bore comprising: an inflatable packer element incorporating a cylinder and an elastomer sleeve provided on the exterior surface thereof, the elastomer sleeve being retained by retaining means adjacent the cylinder at the end portions of the sleeve but free of the cylinder intermediate the end portions; an aperture defined by the wall of the cylinder for connecting the exterior of the cylinder in a region where the elastomer sleeve is free thereof to the interior of the cylinder; means for releasably connecting the packer element to a well bore string; means for causing fluid from within the cylinder to flow through the aperture and between the elastomer sleeve and exterior surface of the cylinder to radially expand the elastomer sleeve; and means for trapping fluid which has flowed into the chamber between the elastomer sleeve and the cylinder to prevent relaxation of the elastomer sleeve.

A hydraulic anchor packer of this type is shown in U.S. Pat. No. 3,270,814. In this packer anchor, however, no provision is made releasing the anchor from the well bore string used to position it and accordingly if circumstances require release of the anchor packer form the drill string a separate release tool must be provided.

The present invention is characterized in that the means for trapping fluid comprises a piston having a first position in which the aperture is in communication with the interior of the well bore string and the packer element is connected to the well bore string and a second position in which the aperture is isolated from the interior of the well bore string and the packer element is released from the well bore string, and means are provided for shifting the piston from the first position to the second position when the pressure differential across the piston exceeds a predetermined value to trap fluid in the chamber and release the packer element from the well bore string.

The hydraulic anchor packer of the present invention may be run into a well bore by means of a conveying string until a desired depth is achieved. The hydraulic anchor packer may be then set by pumping well bore fluid down the conveying string to the cylinder and activating the means for causing fluid within the cylinder to flow through the aperture. The resulting flow of well bore fluid between the elastomer sleeve and the exterior surface of the cylinder causes the elastomer sleeve to deform radially and press against the neighbouring wall of the well bore. The pressure of the fluid located between the elastomer sleeve and the cylinder is increased until the friction forces between the elastomer sleeve and the wall of the well bore secure the anchor packer in position. The piston moves from its first position to its second position when the pressure differential across it reaches a predetermined value, thereby trapping the fluid which has inflated the packer and releasing the packer from the well bore string. The force exerted on the wall of the well bore by the elastomer sleeve is maintained by preventing the leakage of fluid from the chamber formed between the elastomer sleeve and the cylinder.

The inflatable packer element may incorporate a retaining shoulder provided on the cylinder adjacent each end portion of the elastomer sleeve. Preferably, the retaining shoulders are provided as nuts threadedly engaged with the cylinder.

The retaining means may comprise a bond between the surfaces of the elastomer sleeve and an adjacent retaining shoulder. The retaining means may also comprise a bond between the surfaces of the elastomer sleeve and the cylinder. In each case, the bond may be provided by an adhesive. Furthermore, it is preferable for the retaining means to comprise at least one reinforcing element engaging an adjacent end portion of the elastomer sleeve. The or each reinforcing element is preferably mounted on the cylinder and more preferably attached to a retaining shoulder. It is also desirable for the or each reinforcing element to be embedded in an adjacent end portion of the elastomer sleeve.

The primary function of the retaining means is to retain the end portions of the elastomer sleeve adjacent the cylinder so as to prevent leakage of well bore fluid.

The means for causing fluid to flow through the aperture preferably comprises a drop ball and a seat located within the cylinder for receiving the drop ball. The means is activated by introducing the drop ball into the fluid flow within the conveying string. The drop ball is carried down the string by the fluid flow until it is received by the seat within the cylinder. A seal is formed between the drop ball and the seat preventing the passage of well bore fluid. The fluid flow is thereby diverted through the aperture in the cylinder which is located up-hole of the drop ball and seat.

Furthermore, it is preferable for the inflatable packer element to be mounted on an exterior surface of a mandrel having an inflate port adapted to communicate fluid to the aperture in the cylinder; the means for causing fluid to flow through the aperture and the means for trapping fluid being located within the mandrel. The inflatable packer element may be releaseably mounted on the mandrel. The inflatable packer element may be thereby readily removed from the main body of the hydraulic anchor packer for the purposes of maintenance or replacement.

A serrated metallic gripping element may also be provided on the exterior surface of the elastomer sleeve.

The hydraulic anchor packer of the present invention has the advantage over the traditional anchor packers of being simple and inexpensive to manufacture and use. The invention has the further advantage of being suitable for use in both cased and uncased well bores.

Figure 2:
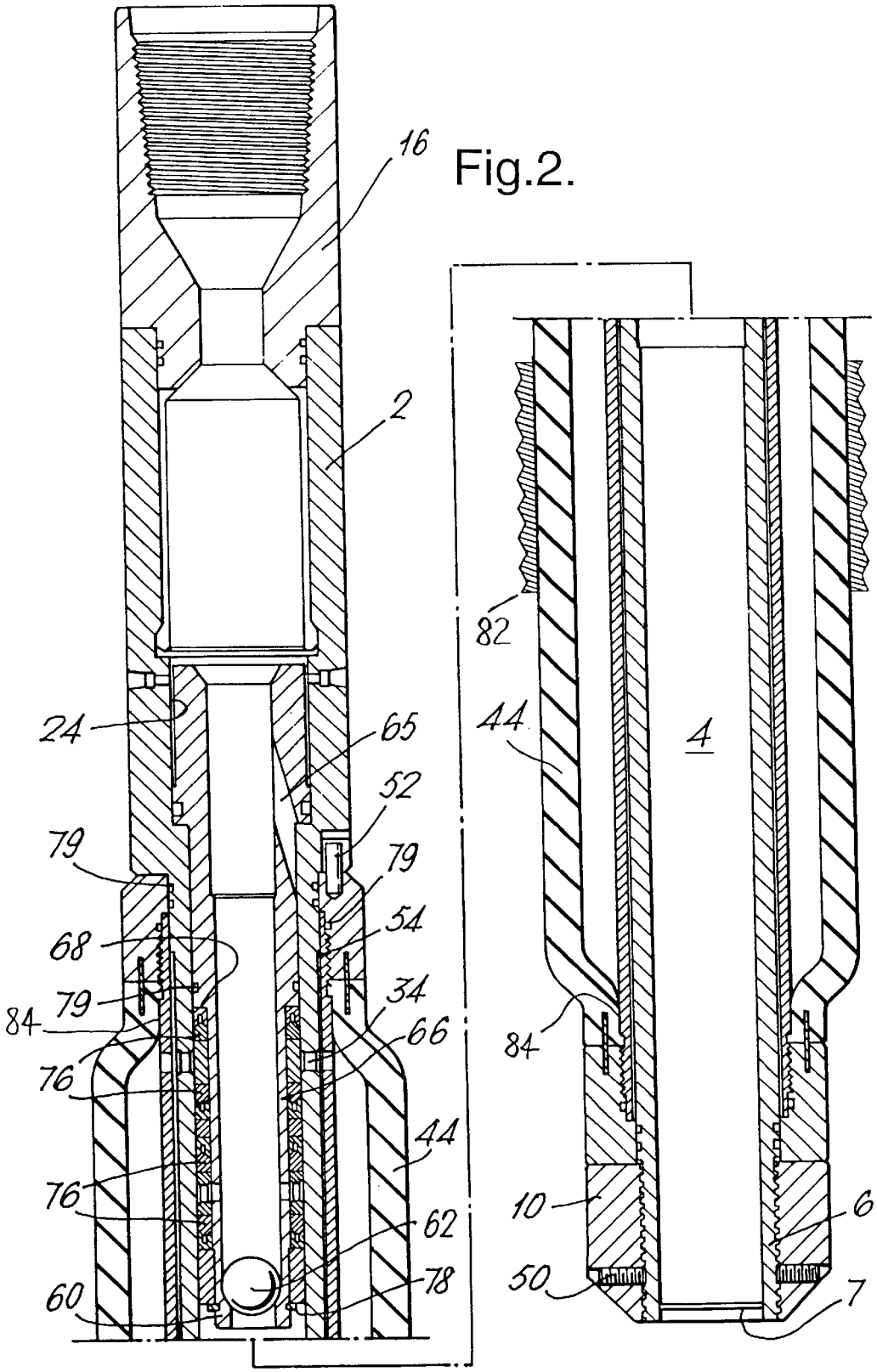

An embodiment of the present invention will now be described with reference to the accompanying drawings, in which:

FIG. 1 is a cross-sectional view of the hydraulic anchor packer of the present invention configured in an unset position; and FIG. 2 is a cross-sectional view of the hydraulic anchor packer of FIG. 1 configured in a set position.

The embodiment of the present invention shown in FIGS. 1 and 2 incorporates a plurality of components mounted on a mandrel 2.

The mandrel 2 is substantially cylindrical in shape and defines a bore 4 through which well bore fluid may pass when the apparatus is in use. The lower end 6 of the mandrel 2 is provided with a filter screen 7 for the filtering of well bore fluid entering the lower end 6 from the annulus. Circumstances may be such that the provision of the filter screen 7 is not necessary. Further filter screens may be provided either within the anchor packer or within the conveying string to filter well bore fluid flowing down the string.

An external screw thread 8 is also provided on the lower end 6 for receiving a retaining nut 10. The upper end 14 of the mandrel 2 is adapted to receive a top sub 16. The top sub 16 is provided with a collett 18 having a plurality of fingers 20. The ends of the fingers 20 are formed so as to locate within a recess 22 defined by the interior surface 24 of the mandrel 2. The top sub 16 may be thereby attached to the upper end 14 of the mandrel 2. An internal screw thread 26 is provided on the top sub 16 for the reception of a conveying string (not shown).

An internal shoulder 28 is formed on the interior surface 24 of the mandrel, and an external shoulder 30 is formed on the exterior surface 32 of the mandrel. Inflate ports 34 are provided in the wall of the mandrel 2 below the external shoulder 30.

An inflate packer element 36 is arranged on the exterior surface 32 of the mandrel 2 and extends from the external shoulder 30 to the lower end 6. The inflatable packer element 36 is a discrete assembly of components which may be readily removed from the mandrel 2 for the purposes of maintenance or replacement. The components of the inflatable packer element 36 include a cylinder 38, an upper and lower nut 40,42, an elastomer sleeve 44 and a plurality of reinforcing elements 46. The upper and lower nuts 40,42 are threadedly engaged with the upper and lower ends of the cylinder 38 respectively so as to provide retaining shoulders against which end portions of the elastomer sleeve 44 abut. The elastomer sleeve 44 extends about the cylinder 38 between the upper and lower nuts 40,42. Metallic serrated grips 82 are also provided on the external surface of elastomer sleeve 44 to assist the elastomer sleeve 44 in gripping the wall of the well bore.

The elastomer sleeve is manufactured from a rubber material, but may be produced from any other material having suitable elastic properties. The end portions of the elastomer sleeve 44 are retained adjacent the cylinder 38 and the upper and lower nuts 40,42 by bonding means 84 such as a suitable adhesive or other fixing agent. The attachment is reinforced by the reinforcing elements 46 which consist of twenty four spring bars 47. The spring bars 47 project from each nut 40,42 so as to penetrate the end portions of the elastomer sleeve 44. Apertures 48 are provided in the cylinder 38 between the parts of the cylinder 38 attached to the end portions of the elastomer sleeve 44.

The inflate packer element 36 is assembled by firstly screwing the nuts 40,42 onto the respective ends of the cylinder 38. The areas of the cylinder 38, the nuts 40,42 and the reinforceing elements 46 to be attached to the elastomer sleeve 44 are then shot blasted and applied with a fixing agent. The elastomer sleeve 44 is then finally applied by means of conventional compression moulding techniques. Injection moulding techniques may be used as an alternative to compression moulding.

The inflatable packer element 36 is slidably located on the mandrel 2 so that the upper nut 40 abuts the external shoulder 30. Axial movement of the inflatable packer element 36 in the direction of the lower end 6 of the mandrel 2 is prevented by means of the retaining nut 10 which is threadedly engaged with the lower end 6 so as to abut the lower nut 42. The retaining nut 10 is secured in position by means of lock screws 50. Rotational movement of the inflatable packer element 36 relative to the mandrel 2 is prevented by means of an alignment dowel 52. A step 54 in the exterior surface 32 provides an annular space between the cylinder 38 and the mandrel 2, thereby ensuring fluid communication between the aperture 48 and the inflate port 34.

A piston 56 is slidably located within the bore 4 of the mandrel 2. The piston 56 is substantially cylindrical in shape and defines a bore 58 through which well bore fluid may pass when the hydraulic anchor packer is in use. The lower end of the piston bore 58 is provided with a seat 60 for receiving a drop ball 62. The upper end of the piston 56 is provided with an external piston shoulder 64 which, when in use, abuts the internal shoulder 28 so as to limit the axial movement of the piston 56 towards the lower end 6 of the mandrel 2. A pressure relief port 65 is formed in the upper end of the piston 56. When the piston 56 moves axially towards the lower end 6, well bore fluid located between the external piston shoulder 64 and the internal shoulder 28 flows through the pressure relief port 65. The movement of the piston 56 is thereby assisted. Alternative means of allowing fluid to flow from between the external piston shoulder 64 and the internal shoulder 28 may be provided as appropriate.

A lower wall 66 of the piston 56 is spaced from the interior surface 24 of the mandrel 2 below a step 68. Flow ports 70 are provided in the lower wall 66. The space between the lower wall 66 and the interior surface 24 is occupied by an isolating ring 72 and a flow port ring 74. The isolating ring 72 is provided as a solid ring of material, whereas the flow port ring 74 is provided as a ring of material incorporating a plurality of holes. Undesirable leakage of well bore fluid between the mandrel 2 and the lower wall 66 is prevented by means of lip seals 76. The isolating ring 72, the flow port ring 74 and the lip seals 76 are retained in position by means of a circlip 78. Additional seals 79 are provided throughout the hydraulic anchor packer to prevent further leakage of well bore fluid.

FIG. 1 shows the hydraulic anchor packer arranged in an unset position. In this configuration, the piston 56 is located in abutment with the fingers 20 of the collett 18. The upper portion of the piston 56 engages the collett 18 so as to press the ends of the fingers 20 into the recess 22. Movement of the piston 56 is prevented by means of shear pins 80. The top sub 16 is thereby securely attached to the mandrel 2. When the piston 56 is located as shown in FIG. 1, the piston bore 58 is in fluid communication with the apertures 48 through the flow ports 70 and the holes in the flow port ring 74.

When in use, the hydraulic anchor packer is attached to a conveying string and located within a well bore. Once the anchor packer has been correctly positioned, the apparatus may be set by pumping well bore fluid down the conveying string and through the bores 4,58, and by then introducing a drop ball 62 into the fluid flow. The drop ball 62 may be introduced into the fluid flow either at the surface or at some point along the length of the conveying string. When the drop ball 62 is released from a location along the conveying string, suitable means (not shown) for holding and releasing the drop ball must be provided.

When the drop ball 62 is received by the seat 60, the flow of well bore fluid through the piston bore 58 is diverted through the flow ports 70, the flow port ring 74, the inflate ports 34 and the apertures 48. The well bore fluid is thereby directed between the cylinder 38 and the elastomer sleeve 44. The elastomer sleeve 44 is expanded and displaced radially by the well bore fluid so as to abut the wall of the well bore. However, the end portions of the elastomer sleeve 44 remain adjacent to the cylinder 38 and the upper and lower nuts 40,42, thereby preventing an undesirable leakage of well bore fluid. Once the pressure of the fluid located between the cylinder 38 and the elastomer sleeve 44 has increased to a predetermined level, the shear pins 80 shear and the piston 56 moves axially within the mandrel 2 to the set position shown in FIG. 2 in response to a hydraulic pressure differential. In this position, the isolating ring 72 isolates the fluid located between the cylinder 38 and the elastomer sleeve 44 from the well bore fluid located within the piston bore 58. Whilst the apparatus is configured in the set position, the piston 56 is spaced from the collett 18 thereby leaving the fingers 20 free to slide from the recess 22. Removal from the well bore of the top sub 16 and conveying string is then possible without loss of fluid from between the cylinder 38 and the elastomer sleeve 44. The arrangement of the piston 56 is such that the isolating ring 72 locates so as to seal the inflate ports 34 before the piston 56 becomes spaced from the collett 18 to release the top sub 16.

The present invention is not limited to the specific embodiment described above. Alternative arrangements and suitable materials will be apparent to the reader skilled in the art. For example, the retaining shoulders formed using the upper and lower nuts 40,42, may be alternatively formed as an integral part of the cylinder 38 using welding or machining techniques.

Also, the manner in which the end portions of the elastomer sleeve 44 are retained may differ from that described above. For instance, the reinforcing elements 46 may be omitted. Alternatively, the end portions of the elastomer sleeve may be attached to just the retaining shoulders rather than to both the retaining shoulders and the adjacent surface of the cylinder 38. Indeed, since the primary function of the retaining means is to prevent a leakage of well bore fluid, the method of retaining the end portions may allow axial movement of the end portions along the cylinder 38 provided that a suitable seal is maintained. Such axial movement of the end portions can be desirable because the radial displacement achievable by the elastomer sleeve 44 is increased.

What is claimed is:

1. A hydraulic anchor packer for use in a well bore comprising:

in inflatable packer element incorporating a cylinder and an elastomer sleeve provided on the exterior surface thereof, the elastomer sleeve being retained by retaining means adjacent the cylinder at the end portions of the sleeve but free of the cylinder intermediate the end portions;

an aperture defined by the wall of the cylinder for connecting the exterior of the cylinder in a region where the elastomer sleeve is free thereof to the interior of the cylinder;

means for releasably connecting the packer element to a well bore string;

means for causing fluid from within the well bore string to flow through the aperture and between the elastomer sleeve and exterior surface of the cylinder to radially expand the elastomer sleeve; and means for trapping fluid which has flowed into the chamber between the elastomer sleeve and the cylinder to prevent relaxation of the elastomer sleeve the means for trapping fluid comprises a piston having a first position in which the aperture is in communication with the interior of the well bore string and the packer element is connected to the well bore string, and a second position in which the aperture is isolated from the interior of the well bore string and the packer element is released from the well bore string, and means are provided for shifting the piston from the first position to the second position when the pressure differential across the piston exceeds a predetermined value to trap fluid in the chamber and release the packer element form the well bore string.

2. The hydraulic anchor packer as claimed in claim 1, wherein a retaining shoulder is provided on the cylinder adjacent each end portion of the elastomer sleeve.

3. The hydraulic anchor packer as claimed in claim 2, wherein at least one retaining shoulder is provided by a nut threadedly engaged with the cylinder.

4. The hydraulic anchor packer as claimed in claim 2, wherein the retaining means comprises a bond between the surfaces of the elastomer sleeve and an adjacent retaining shoulder.

5. The hydraulic anchor packer as claimed in claim 4, wherein the bond of the retaining means is provided by an adhesive.

6. The hydraulic anchor packer as claimed in claim 1, wherein the retaining means comprises a bond between the surfaces of elastomer sleeve and the cylinder.

7. The hydraulic anchor packer as claimed in claim 1, wherein the retaining means comprises at least one reinforcing element engaging an adjacent end portion of the elastomer sleeve.

8. The hydraulic anchor packer as claimed in claim 7, wherein the or each reinforcing element is mounted on the cylinder.

9. The hydraulic anchor packer as claimed in claim 8, wherein the or each reinforcing element is attached to a retaining shoulder provided on the cylinder.

10. The hydraulic anchor packer as claimed in claim 7, wherein the or each reinforcing element is embedded in the adjacent end portion of the elastomer sleeve.

11. The hydraulic anchor packer as claimed in claim 1, wherein the means for causing fluid to flow through the aperture comprises a drop ball and a seat located on the piston.

12. The hydraulic anchor packer as claimed in claim 1, wherein the piston has a flow port located in the wall of the piston and, when the piston is in the first position, the flow port is in fluid communication with the aperture.

13. The hydraulic anchor packer as claimed in claim 12, wherein a shear pin is provided to releasably hold the piston in the first position.

14. The hydraulic anchor packer as claimed in claim 12, wherein movement of the piston to the second position releases said means for releasably connecting the hydraulic anchor packer to said well bore string.

15. The hydraulic anchor packer as claimed in claim 12, where a seat is provided on the piston of the means for trapping fluid.

16. The hydraulic anchor packer as claimed in claim 1, wherein the inflatable packer element is mounted on an exterior surface of a mandrel having an inflate port adapted to communicate fluid to the aperture in the cylinder; the means for causing fluid to flow through the aperture and the means for trapping fluid being located within the mandrel.

17. The hydraulic anchor packer as claimed in claim 16, wherein the inflatable packer element is releasably mounted on the mandrel.

18. The hydraulic anchor packer as claimed in claim 1, wherein at least one serrated metallic gripping element is provided on the exterior surface of the elastomer sleeve.

* * * * *